US006566303B2

(12) United States Patent
Nakamura

(10) Patent No.: US 6,566,303 B2
(45) Date of Patent: May 20, 2003

(54) THERMAL TRANSFER MATERIAL AND IMAGE FORMING MATERIAL USING THE SAME

(75) Inventor: Hideyuki Nakamura, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 110 days.

(21) Appl. No.: 09/833,814

(22) Filed: Apr. 13, 2001

(65) Prior Publication Data

US 2002/0048657 A1 Apr. 25, 2002

(30) Foreign Application Priority Data

Apr. 14, 2000 (JP) ..... 2000-113586

(51) Int. Cl.[7] ..... B41M 5/035; B41M 5/38

(52) U.S. Cl. ..... 503/227; 428/195; 430/945

(58) Field of Search ..... 8/471; 430/200, 430/945; 503/227; 428/195

(56) References Cited

FOREIGN PATENT DOCUMENTS

JP 2001-39040 2/2001

*Primary Examiner*—Pamela R. Schwartz
(74) *Attorney, Agent, or Firm*—Sughrue Mion, PLLC

(57) ABSTRACT

A thermal transfer material which has at least a light to heat converting layer and an image forming layer on a supporting body, and the image forming layer containing at least one compound which is selected from the compounds which are represented in the following general formula (1) and the following general formula (2). In the general formula (1), $R^1$ represents a hydrogen atom, an alkyl group having 1 to 5 carbon atoms, a halogen atom, or an alkoxy group having 1 to 5 carbon atoms; and $R^2$ represents a hydrogen atom or an alkyl group having 1 to 5 carbon atoms. n represents any integer of 1 to 4. In the general formula (2), $R^3$ and $R^4$ represent respectively independently a nitro group, a halogen atom, a methylsulfonyl group, or a cyano group.

General Formula (1)

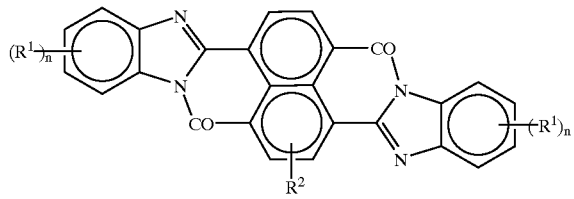

General Formula (2)

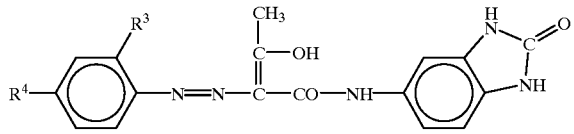

18 Claims, No Drawings

THERMAL TRANSFER MATERIAL AND IMAGE FORMING MATERIAL USING THE SAME

BACKGROUND OF THE INVENTION

1. Field of the Invention

The present invention relates to a thermal transfer material which thermal transfers by laser illumination and to an image forming material using the same. In particular, the present invention relates to a thermal transfer material which can be used for forming a color proof (DDCP: direct digital color proof) or a mask image in the field of printing by utilizing laser illumination based on a digital image signal, and to an image forming material using the thermal transfer material.

2. Description of the Related Art

An example of a conventional thermal transfer recording technique is as follows. An image receiving material and a thermal transfer material, in which a heat melting color material layer or a color material layer containing a heat sublimating dye is provided on a supporting body, are superposed. The thermal transfer material side is heated imagewise by a heating device, such as a thermal head, an energized head, or the like, which is controlled by an electric signal. Thus, the image is transferred and recorded onto the image receiving material.

Such a thermal transfer recording technique has the characteristics that noise is low, there is no need for maintenance, the cost is low, coloring is easy, digital recording is possible, and the like. This technique is utilized in many fields such as various types of printers, recorders, facsimiles, computer terminals, and the like.

The recent years, a so-called digital recordable recording method, with which resolution is higher, high speed recording is possible, and image processing is possible, has come to be demanded in the fields of medical care, printing, and the like. However, in the thermal transfer recording method using a heating device such as a thermal head, an energized head, or the like, the resolution is limited by a density at which the head heating elements are disposed. Moreover, due to the heat generating characteristics of the heating elements, it is difficult to control the heating temperature of the heating elements at high speed, and it is difficult to obtain an image having higher resolution even faster.

Therefore, in recent years, a laser recording technique which utilizes a light to heat converting operation by laser illumination has attracted attention and has been manufactured as a system which can obtain an image having higher resolution at high speed.

In an image forming system which utilizes this laser recording technique, in particular, a single mode laser is used in general from the standpoint of obtaining a beam which is extremely narrow and has a small focal point. Because such a single mode laser has good beam quality, an image having high resolution is obtained. Further, regarding the recording speed as well, an image can be formed at high speed as compared to recording by a conventional heating device such as a thermal head or the like.

However, in the laser recording, since the focus beam diameter of a laser light having comparatively large energy is converged to about 10 $\mu$m and used, light-to-heat conversion is effected highly efficiently and extremely high heat energy is obtained as compared to a case using a heating device, such as a thermal head or the like, which is used for heat recording. As a result, the temperature of a region which is subjected to laser illumination reaches an extremely high temperature locally, and a coloring agent (pigment), which is included in the image forming layer, in the illuminated region may undergo thermal decomposition. When the coloring agent undergoes thermal decomposition, the hue of the coloring agent is lost, and the image density of an image which is transferred onto the image receiving layer decreases.

Further, in recent years, an attempt to increase the image recording speed has been made using a multimode semiconductor laser which has a higher output than the single mode laser. However, the multimode semiconductor laser has drawbacks in that it is difficult to converge a laser beam in the transverse direction and that the focus beam diameter cannot be converged to 20 $\mu$m or less. Thus, when a highly minute image in which a sub-scanning pitch is approximately 10 $\mu$m in the field of medical care, printing, or the like is recorded by using the multimode semiconductor laser, adjacent beams are overlapped with each other. As a result, the overlapped region is heated excessively, the thermal decomposition of a coloring agent as described above progresses even further, and the density of the transferred image is lowered even more.

Accordingly, also in cases in which recording is carried out using the above-described laser having high output and having overlapping of adjacent beams, there is still the demand for a material in which it is difficult for thermal decomposition to occur even at high temperatures.

In general, the coloring agent which is used in the image forming layer is a pigment or the like. However, there are often cases in which, when the pigment is subjected to thermal decomposition, substances which are harmful to the human body are discharged from the pigment. Consequently, in recent years, a technique which can prevent or reduce the generation of harmful substances has come to be demanded as there are demands for improving safety and the operation environment.

SUMMARY OF THE INVENTION

An object of the present invention is to solve the above-described conventional problems, and to provide a thermal transfer material and an image forming material, in which it is difficult for decomposition of a coloring agent to occur at the time of forming an image, which are very safe, and which can form a vivid image having good hue.

A first aspect of the present invention is a thermal transfer material which has at least a light to heat converting layer and an image forming layer on a supporting body, wherein the image forming layer contains at least one compound which is selected from compounds which are represented by following general formula (1) and following general formula (2):

General Formula (1)

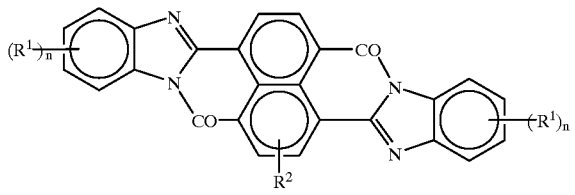

wherein, $R^1$ represents a hydrogen atom, an alkyl group having 1 to 5 carbon atoms, a halogen atom, or an alkoxy group having 1 to 5 carbon atoms; $R^2$ represents a hydrogen atom or an alkyl group having 1 to 5 carbon atoms; and n represents any integer of from 1 to 4;

General Formula (2)

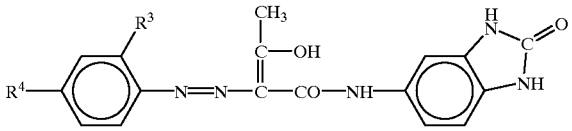

wherein, $R^3$ and $R^4$ respectively and independently represent a nitro group, a halogen atom, a methylsulfonyl group, or a cyano group.

A second aspect of the present invention is an image forming material which is formed by a thermal transfer material and an image receiving material, wherein the thermal transfer material has at least a light to heat converting layer and an image forming layer on a supporting body, and the image forming layer contains at least one compound which is selected from compounds which are represented by following general formula (1) and following general formula (2), and the image receiving material having an image receiving layer on a supporting body:

General Formula (1)

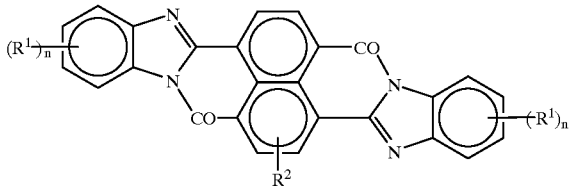

wherein, $R^1$ represents a hydrogen atom, an alkyl group having 1 to 5 carbon atoms, a halogen atom, or an alkoxy group having 1 to 5 carbon atoms; $R^2$ represents a hydrogen atom or an alkyl group having 1 to 5 carbon atoms; and n represents any integer of from 1 to 4;

General Formula (2)

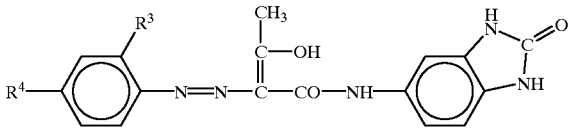

wherein, $R^3$ and $R^4$ respectively and independently represent a nitro group, a halogen atom, a methylsulfonyl group, or a cyano group.

A third aspect of the present invention is a laser thermal transfer recording method, comprising the steps of: (a) manufacturing a thermal transfer material which includes formation of a light to heat converting layer on a supporting body and formation of an image forming layer which contains at least one compound which is selected form compounds represented by following general formula (1) and following general formula (2); (b) manufacturing an image receiving material which includes formation of an image receiving layer on a supporting body; (C) superposing the thermal transfer material and the image receiving material such that the image forming layer and the image receiving layer contact one another; (d) illuminating a laser imagewise; and (e) peeling the thermal transfer material and the image receiving material:

General Formula (1)

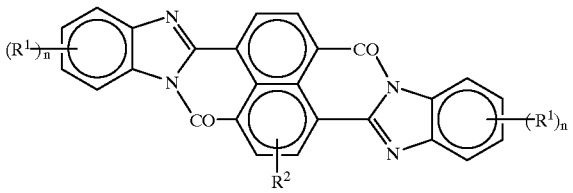

wherein, $R^1$ represents a hydrogen atom, an alkyl group having 1 to 5 carbon atoms, a halogen atom, or an alkoxy group having 1 to 5 carbon atoms; $R^2$ represents a hydrogen atom or an alkyl group having 1 to 5 carbon atoms; and n represents any integer of from 1 to 4;

General Formula (2)

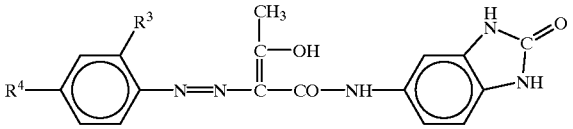

wherein, $R^3$ and $R^4$ respectively and independently represent one of a nitro group, a halogen atom, a methylsulfonyl group, or a cyano group.

DESCRIPTION OF THE PREFERRED EMBODIMENTS

Thermal Transfer Material

A thermal transfer material of the present invention has the characteristic that, in the thermal transfer material which has at least a light to heat converting layer and an image forming layer, the image forming layer contains at least one compound (the compound may be hereinafter referred to as "compound of the present invention") which is selected from the compounds represented by above general formula (1) and above general formula (2). An embodiment of the present invention includes, for example, a thermal transfer material in which the light to heat converting layer and the above image forming layer are superposed on a supporting body in that order. Moreover, an aspect of the present invention, which is applied to the thermal transfer material for forming a full color image, includes a thermal transfer material on which three image forming layers for cyan coloring, magenta coloring, and yellow coloring are superposed.

Image Forming Layer

The above-described compound of the present invention functions as a magenta coloring agent in the image forming layer. Accordingly, in the above thermal transfer material for forming a full color image, it is preferable that the magenta coloring layer contains the compound. Further, in the image forming layer, it is preferable that the compound is used together with other magenta coloring agents. It is difficult for the above compound of the present invention to undergo thermal decomposition even if thermal energy is supplied thereto at the time of forming an image. Thus, generation of harmful substances such as benzidine or the like can be prevented, and lowering of the image density due to the decomposition of the coloring agent can be reduced. As a result, the thermal transfer material of the present invention is very safe and can form a vivid image having good hue.

Compound Represented by General Formula (1)

In the above general formula (1), $R^1$ represents a hydrogen atom, an alkyl group having 1 to 5 carbon atoms, a halogen atom, or an alkoxy group having 1 to 5 carbon atoms. The above-described alkyl group may form a straight chain shape or a branched shape. Examples of the alkyl group include a methyl group, an ethyl group, an n-propyl group, an i-propyl group, an n-butyl group, or the like.

Examples of the halogen atom include a chlorine atom, a bromine atom, an iodine atom, or the like. Among them, a chlorine atom is preferable.

An alkyl portion of the above alkoxy group may be a straight chain-shaped alkyl group or a branch-shaped alkyl group. Examples of the above alkoxy group include a methoxy group, an ethoxy group, or the like. Among them, an ethoxy group is preferable.

$R^1$ is preferably a hydrogen atom.

In the above general formula (1), $R^2$ represents a hydrogen atom or an alkyl group having 1 to 5 carbon atoms. The alkyl group may form a straight chain shape or a branched shape. Examples of the alkyl group include a methyl group, an ethyl group, an n-propyl group, an i-propyl group, an n-butyl group, or the like. Among them, $R^2$ is preferably a hydrogen atom.

In the above general formula (1), n represents any integer of from 1 to 4. n is preferably 1 or 2.

Among the compounds represented by the above general formula (1), a compound in which $R^1$ and $R^2$ are hydrogen atoms is preferable from the standpoints of hue and thermal decomposition resistance.

Compound Represented by General Formula (2)

In the above general formula (2), $R^3$ and $R^4$ respectively and independently represent a nitro group, a halogen atom, a methylsulfonyl group, or a cyano group.

Examples of the halogen atom include a chlorine atom, a bromine atom, an iodine atom, or the like. Among them, a chlorine atom is preferable.

Among the compounds represented by the above general formula (2), a compound in which $R^3$ is a nitro group and $R^4$ is a chlorine atom is preferable from the standpoints of hue and thermal decomposition resistance.

Concrete examples of the compound which is represented by the above general formula (1) (illustrative compounds (1)-1 to (1)-4) and concrete examples of the compound which is represented by the above general formula (2) (illustrative compounds (2)-1 and (2)-2) are shown below. However, the compounds which are used in the present invention are not limited to the following compounds.

(1)-1

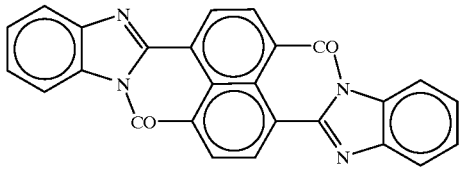

-continued (1)-2

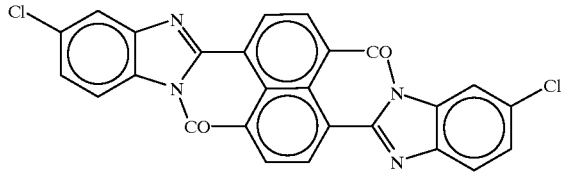

(1)-3

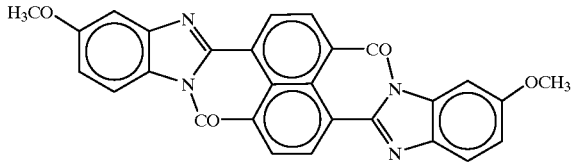

(1)-4

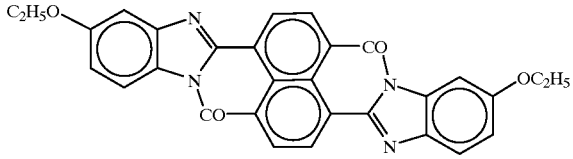

(2)-1

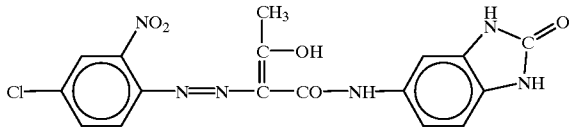

(2)-2

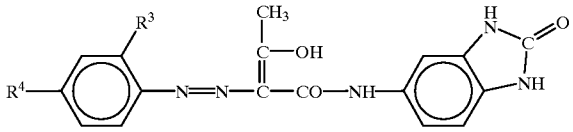

The compound which is represented by the above general formula (1) and the compound which is represented by the above general formula (2) can be synthesized in accordance with general methods which are described, for example, in a pigment manual or the like.

The compound of the present invention may be used alone, or a combination of two or more compounds which are selected from the compounds represented by above general formula (1) and (2) may be used.

The above image forming layer may contain another coloring agent in addition to the compound of the present invention. In particular, as mentioned above, it is preferable that the image forming layer for magenta coloring contains the compound of the present invention together with another magenta coloring agent.

The magenta coloring agent which can be used together is preferably a magenta pigment. Examples of inorganic pigments include cadmium red, red iron oxide, vermilion, red lead, antimony vermilion, or the like. Moreover, examples of organic pigments include an azo pigment of azo lake system, an insoluble azo system (monoazo system, disazo system, condensed azo system), condensed azo pigment, an anthraquinone pigment which is a condensed polycyclic pigment, a thioindigo pigment, a perinon pigment, a perylene pigment, and a quinacridone pigment.

Examples of the azo pigment of azo lake system include brilliant carmine 6B (pigment Red 57:1), lake red (pigment Red 53:1), permanent red F5R (pigment Red 48), lithol red (pigment Red 49), Persian orange (pigment Orange 17), Croceine Orange (pigment Orange 18), helio orange TD (pigment Orange 19), pigment scarlet (pigment Red 60:1), brilliant scarlet G (pigment 64:1), hello red RMT (pigment Red 51), Bordeaux 10B (pigment Red 63), and helio Bordeaux BL (pigment Red 54).

Examples of the above insoluble azo system (monoazo system, disazo system, condensed azo system) include Para Red (pigment Red 1), lake red 4R (pigment Red 3), permanent orange (pigment Orange 5), permanent red FR2 (pigment Red 2), permanent red FRLL (pigment Red 9), permanent red FGR (pigment Red 112), brilliant carmine BS (pigment Red 114), permanent carmine FB (pigment Red 5), P.V. carmine HR (pigment Red 150), permanent carmine FBB (pigment Red 146), novapalm red F3RK-F5RK (pigment Red 170), novapalm red HFG (pigment Orange 38), novapalm red HF4B (pigment Red 187), novapalm orange HL.HL-70 (pigment Orange 36), P. V. carmine HF4C (pigment Red 185), hostapalm Brown HFR (pigment Brown 25), Vulcan orange (pigment Orange 16), pyrazolone orange (pigment Orange 13), and pyrazolone red (pigment Red 38).

Examples of yellow coloring agents include inorganic chrome yellow, cadmium yellow, yellow iron oxide, titan yellow, ochre, an acetoacetic anilide monoazo pigment of refractory metallic salt (azo lake), an acetoacetic anilide disazo pigment, a condensed azo pigment, a benzimidazole monoazo pigment, an isoindolinone pigment, and the like.

Examples of the above acetoacetic anilide monoazo pigment of refractory metallic salt (azo lake) include Hanza yellow G (C.I. No. pigment Yellow 1, and the same holds true hereinafter), Hanza yellow 10G (pigment Yellow 3), Hanza yellow RN (pigment Yellow 65), Hanza brilliant yellow 5GX (pigment Yellow 74), Hanza brilliant yellow 10GX (pigment Yellow 98), permanent yellow FGL (pigment Yellow 97), Simra lake fast yellow (pigment Yellow 133), lyonol yellow K-2R (pigment Yellow 169), and the like.

Examples of the above acetoacetic anilide disazo pigment include disazo yellow G (pigment Yellow 12), disazo yellow GR (pigment Yellow 13), disazo yellow 5G (pigment Yellow 14), disazo yellow 8G (pigment Yellow 17), disazo yellow R (pigment Yellow 55), permanent yellow HR (pigment Yellow 83), and the like.

Examples of the above condensed azo pigment include chromophthal yellow 3G (pigment Yellow 93), chromophthal yellow 6G (pigment Yellow 94), and chromophthal yellow GR (pigment Yellow 95).

Examples of the above benzimidazole monoazo pigment include hostapalm yellow H3G (pigment Yellow 154), hostapalm yellow H4G (pigment Yellow 151), hostapalm yellow H2G (pigment Yellow 120), hostapalm yellow H6G (pigment Yellow 175), and hostapalm yellow HLR (pigment Yellow 156).

Examples of the above isoindolinone pigment include illugadin yellow 3RLTN (pigment Yellow 110), illugadin yellow 2RLT, illugadin yellow 2GLT (pigment Yellow 109), fastgen super yellow GROH (pigment Yellow 137), fastgen super yellow GRO (pigment Yellow 110), and sandolin yellow 6GL (pigment Yellow 173).

In addition to the aforementioned, other examples of the yellow coloring agent are a thren pigment such as flavanthrone (pigment Yellow 24), anthramyrimidin (pigment Yellow 108), phthaloylamide type anthoraquinon (pigment Yellow 123), heliofast yellow E3R (pigment Yellow 99), or the like; a metallic complex pigment such as an azo nickel complex pigment (pigment Green 10), a nitroso nickel complex pigment (pigment Yellow 153), an azomethine copper complex pigment (pigment Yellow 117), or the like; a quinophthalone pigment such as a phthalimide quinophthalione pigment (pigment Yellow 138), or the like; and the like.

Examples of cyan coloring agents include an inorganic pigment (such as ultramarine, iron blue, cobalt blue, cerulean blue, or the like) and an organic pigment (such as phthalocyanine pigment or the like).

Examples of the above-described phthalocyanine pigment include fastgen blue BB (pigment Blue 15), Sumiton cyanine blue HB (pigment Blue 15), cyanine blue 5020 (pigment Blue 15:1), Sumika print cyanine blue GN-O (pigment Blue 15), fast sky blue A-612 (pigment Blue 17), cyanine green GB (pigment Green 7), cyanine green S537-2Y (pigment Green 36), Sumiton fast violet RL (pigment Violet 23), and the like.

Moreover, examples of the cyan coloring agent include indanthrone blue (PB-60P, PB-22, PB-21, PB-64) which is a thren pigment, methyl violet phosphorus molybdic acid lake (PV-3) which is a basic dye lake pigment, and the like.

When the compound of the present invention is used together with another pigment, it is preferable that, in the image forming layer, the contained amount of the compound of the present invention is 30% by mass or less based on the contained amount of the other pigment used, and it is more preferable that the contained amount thereof is from 5% by mass or more to 15% by mass or less. If the above-described contained amount exceeds 30% by mass, the amount of thermal decomposition of the pigment increases at the time of laser recording, and image defects such as reduction of image density, uneven transfer, or the like occur. Accordingly, there may be cases in which the desired hue is not obtained.

Further, in each image forming layer, the contained amount of the above coloring agent is preferably from 30% by mass to 70% by mass, and is more preferably from 30% by mass to 40% by mass. Moreover, when a magenta pigment is used as the magenta coloring agent and is used together with the compound of the present invention, in the image forming layer, the total contained amount of the magenta pigment and the compound of the present invention is preferably from 30% by mass to 70% by mass, and is more preferably from 30% by mass to 40% by mass.

The average particle size of the compound of the present invention and the coloring agent which, if desired, is used together therewith is preferably from 0.03 to 1 $\mu$m, and is more preferably from 0.05 to 0.5 $\mu$m. If the particle size is less than 0.03 $\mu$m, dispersion cost may increase, the dispersed solution may be gelatinized, or the like. If the particle size exceeds 1 $\mu$m, coarse particles within the coloring agent may prevent adhesion between a thermal transfer layer and the image receiving layer of an image receiving material.

It is preferable that the above image forming layer contains an amorphous polymer. When the image forming layer contains an amorphous polymer, it is preferable from the standpoint of improving the image quality and the standpoint of increasing the resolving power. In particular, an amorphous polymer having a softening point of from 40 to 150° C. is more preferable due to the above-described points. Examples of the above amorphous polymer include a butyral resin, a polyamide resin, a polyethyleneimine resin, a sulfonamide resin, a polyester polyol resin, a petroleum resin, homopolymers or copolymers of styrene, derivatives of styrene and substitution products of styrene, such as styrene, vinyl toluene, α-methylstyrene, 2-methylstyrene, chlorostyrene, vinyl benzoate, vinyl benzene sulfonic acid soda, aminostyrene, or the like; homopolymers or copolymers with other monomers of vinyl monomers, methacrylic esters and methacrylic acid such as methylmethacrylate, ethylmethacrylate, butylmethacrylate, hydroxyethylmethacrylate, or the like; acrylic esters and acrylic acid such as methylacrylate, ethylacrylate, butylacrylate, α-ethylhexylacrylate, or the like; dienes such as butadiene, isoprene, or the like; acrylnitril; vinyl ethers; maleic acid and maleic acid esters; maleic anhydride; cinnamic acid; vinylchloride, vinylacetale and the like. a homopolymer of vinyl monomer such as chloroethene, vinyl acetate, or the like or copolymer of vinyl monomer with another monomer or the like.

The resins can be used in combination of two or more.

The amount of content of the above amorphous polymer is preferably from 30 to 70% by mass based on the total solid content mass of the image forming layer, and is more preferably from 40 to 60% by mass.

When a number of (e.g., three including yellow, magenta, and cyan, or four including yellow, magenta, cyan, and black) image forming layers (image forming layers on which images are formed) are repeatedly superposed on a supporting body and a multicolor image is formed, the image forming layers preferably include a plasticizer so as to enhance the adhesion between the images.

Examples of the plasticizer include phthalic acid esters such as dibutyl phthalate, di-n-octyl phthalate, di (2-ethylhexyl), dinonyl phthalate, dilauryl phthalate, butyllauryl phthalate, butylbenzyl phthalate, or the like; aliphatic dibasic acid esters such as di (2-ethylhexyl) adipate, di (2-ethylhexyl) sebacate, or the like; triester phosphates such as tricresyl phosphate, tri (2-ethylhexyl) phosphate, or the like; polyol esters such as polyethylene glycol ester or the like; epoxy compounds such as epoxy fatty acid ester, or the like.

Further, in addition to the aforementioned general plasticizers, acrylic acid esters such as polyethylene glycol dimethacrylate, 1,2,4-butane triol trimethacrylate, trimethyrol ethane triacrylate, pentaerytrite triacrylate, pentaerytrite tetraacrylate, pentaerytrite-polyacrylate, or the like can be suitably used depending on the type of binder to be used. The plasticizer may be used in combination of two or more.

Moreover, regarding the amount of the above plasticizer added, in the image forming layer in general, the content ratio (mass ratio) of the sum of the contained amount of pigment and the contained amount of amorphous organic high molecular copolymer to the contained amount of plasticizer is preferably from 100:0.5 to 1:1, and is more preferably from 100:2 to 3:1.

Still further, in addition to the above components, a surface active agent, a thickener, and the like can be added to the image forming layer as occasion demands.

The layer thickness (dry layer thickness) of the above image forming layer is preferably from 0.2 to 1.5 μm, and is more preferably from 0.3 to 1.0 μm. If the layer thickness exceeds 1.5 μm, the resolution may decrease. If the layer thickness is less than 0.2 μm, the stability of the pigment dispersed solution deteriorates and suitability for coating (application) may deteriorate.

The above respective components are dissolved into a solvent or the like and an application solution (application solution for an image forming layer) is prepared. The application solution is applied onto the supporting body in accordance with a known applying method, and then the supporting body is dried. Accordingly, the above image forming layer can be formed.

Examples of the solvent which can be used when the application solution for an image forming layer is prepared include alcohols such as ethyl alcohol, propyl alcohol, or the like; ketones such as acetone, methylethylketone, or the like; esters such as ethyl acetate or the like; aromatic hydrocarbons such as toluene, xylene, or the like; ethers such as tetrahydrofuran, dioxane, or the like; amides such as DMF, N-methylpyrrolidone, or the like; cellosolves such as methylcellosolve or the like; and the like. The solvent can be selected appropriately from the above-described solvents in accordance with the presence/absence of the light to heat converting layer or the like. The above solvents can be used alone or in combination of two or more.

In order to prevent damages, the image receiving material or a protective cover film such as a polyethylene terephthalate sheet, a polyethylene sheet, or the like can be usually superposed on the surface of the image forming layer.

Light to Heat Converting Layer

The above-described light to heat converting layer contains a light to heat converting substance and a binder resin (hereinafter, the binder resin may be referred to as "light to heat converting layer binder polymer"). The light to heat converting layer contains other components as occasion demands.

The above light to heat converting substance is, in general, a laser light absorbable material, such as a dye or the like, which can absorb laser light. Examples of the dye (pigment or the like) include a black pigment such as carbon black, pigment of a macrocyclic compound, such as phthalocyanine, naphthalocyanine, or the like, which has absorption from a visible region to a near infrared region, an organic dye such as an organic dye which is used as a laser absorbing material for a high density laser recording such as an optical disk or the like (a cyanine dye such as an indolenine dye or the like, an anthraquinone dye, an azulene dye, a phthalocyanine dye), and an organic metal compound dye such as a dithiol nickel complex or the like.

From the standpoint of improving the recording sensitivity, it is preferable that the light to heat converting layer is as thin as possible. As a result, it is preferable to use a phthalocyanine dye or an infrared absorption dye, such as a cyanine dye or the like, which has a large absorption coefficient in a laser light wavelength region.

As the above laser light absorbable material, an inorganic material such as a metallic material or the like can be also used. The above-described metallic material is used in a granulated (e.g., blackened silver) state.

The optical density of the light to heat converting substance at a laser absorption wavelength is preferably from 0.1 to 2.0, and is more preferably from 0.3 to 1.2.

If the above optical density is less than 0.1, the sensitivity of the thermal transfer material may be reduced. If the optical density exceeds 2.0, the cost may increase.

The light to heat converting layer binder polymer is preferably a resin having a high glass transition point and a high heat conductivity. Further, it is preferable that the heat resistance (e.g., thermal deformation temperature or thermal decomposition temperature) of the light to heat converting layer binder polymer is higher than that of a material which is used for a layer which is provided on the light to heat converting layer. As the above light to heat converting layer binder polymer, general heat resistant resins can be used.

Examples of the heat resistant resins are methyl polymethacrylate, polycarbonate, polystyrene, ethyl cellulose, nitrocellulose, polyvinyl alcohol, gelatin, polyvinyl pyrrolidone, polyparabanic acid, polyvinyl chloride, polyamide, polyimide, polyetherimide, polysulfone, polyethersulfone, aramid, or the like.

When a plurality of high power lasers such as multimode lasers or the like are disposed and recording is effected, it is preferable that the light to heat converting layer binder polymer uses a polymer having excellent heat resistance. It is more preferable to use a polymer having a glass transition point (Tg) of from 150 to 400° C. and a thermal decomposition temperature (herein, the thermal decomposition temperature refers to a 5% mass reduction temperature Td (in a TGA method, programming rate of 10° C./minute in the air)) of 450° C. or more. It is most preferable to use a polymer having Tg of from 220 to 400° C.

In particular, the polyimide resins which are expressed by the following general formulas (I) to (VII) are soluble in an organic solvent. Because the produceability of the thermal transfer sheet improves, these polyimide resins are preferably used. Further, the polyimide resins are preferable from the standpoints of improving the viscosity stability, the long-term preservability, and the moisture resistance of the application solution for a light to heat converting layer.

(I)

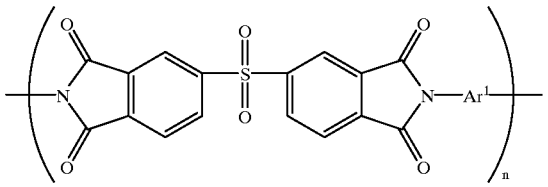

(II)

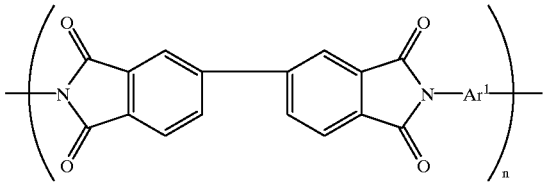

In the above general formulas (I) and (II), $Ar^1$ denotes an aromatic group which is expressed by following structural formulas (1) to (3), and n denotes an integer of from 10 to 100.

(1)

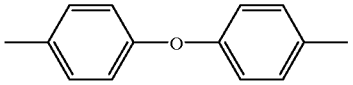

(2)

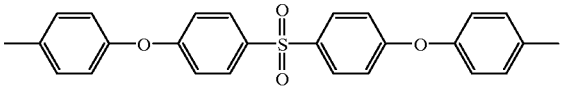

(3)

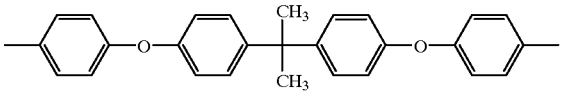

(III)

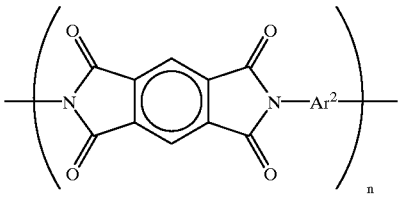

(IV)

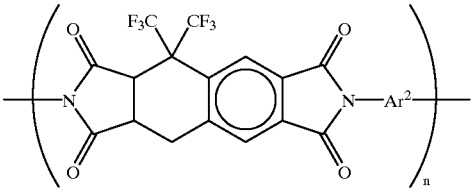

In the above general formulas (III) and (IV), $Ar^1$ denotes an aromatic group which is expressed by the following structural formulas (4) to (7), and n denotes an integer of from 10 to 100.

(4)

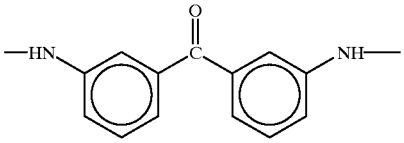

(5)

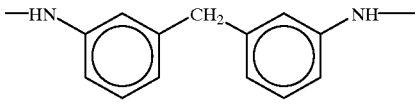

(6)

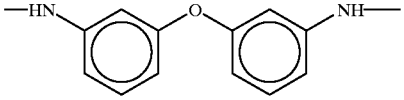

(7)

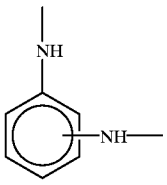

-continued (V)

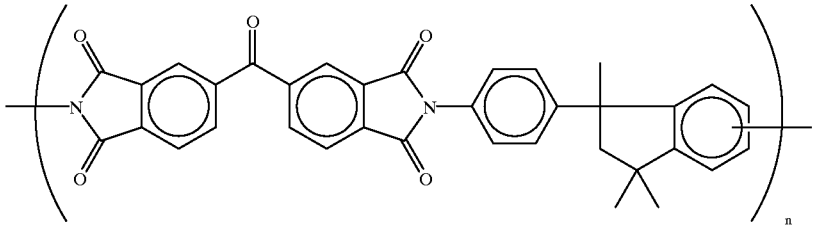

(VI)

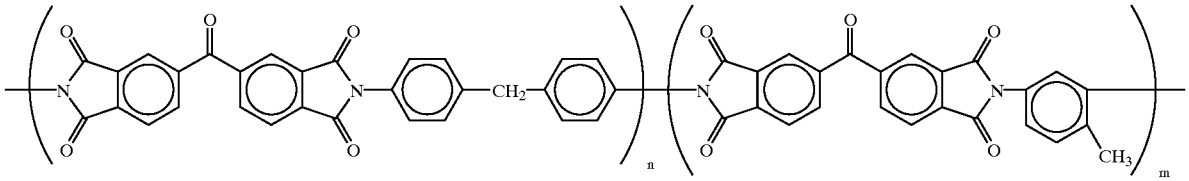

(VII)

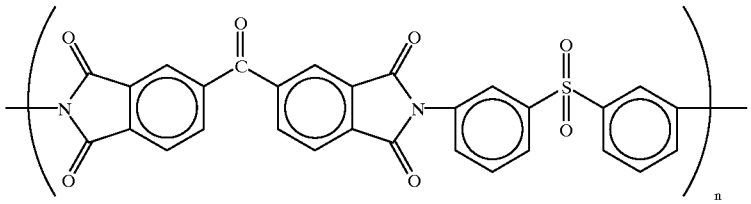

In the above general formulas (V) to (VII), n and m denote an integer of 10 to 100. In formula (VI), the ratio of n to m is from 6:4 to 9:1.

The standard for determining whether the resin is soluble into the organic solvent is set by dissolving 10 parts by mass or more of the resin into 100 parts by mass of N-methylpyrrolidone at 25° C. When 10 parts by mass or more of the resin is dissolved, the resin is preferably used as the resin for a light to heat converting layer. When 100 parts by mass or more of the resin is dissolved into 100 parts by mass of N-methylpyrrolidone, the resin is more preferably used.

The application solution (application solution for a light to heat converting layer), into which the above light to heat converting substance and the light to heat converting layer binder polymer are dissolved, is prepared. The application solution is applied onto the above supporting body, and then the supporting body is dried. Accordingly, the light to heat converting layer can be provided.

Examples of an organic solvent for dissolving the above light to heat converting layer binder polymer include 1,4-dioxane, 1,3-dioxolan, dimethylacetate, N-methyl-2-pyrrolidone, dimethylsulfoxide, dimethylformamide, γ-butyrolactone, or the like.

A method of applying the application solution for a light to heat converting layer can be selected appropriately from known application methods.

The drying is usually carried out at 300° C. or less. More preferably, the drying temperature is 200° C. or less. When polyethylene terephthalate is used as the supporting body, the drying temperature is furthermore preferably within the range of from 80 to 150° C.

The solid content mass ratio of the light to heat converting substance to the light to heat converting layer binder polymer (light to heat converting substance : binder) within the above light to heat converting layer is preferably from 1:20 to 2:1, and is more preferably from 1:10 to 2:1. If the amount of the binder is too small, the cohesive force of the light to heat converting layer is lowered. Thus, when the formed image is transferred onto the image receiving material, the light to heat converting layer is easily transferred together with the formed image and color mixture of the image may occur. If the amount of the above binder is too large, the layer thickness of the light to heat converting layer is increased in order to achieve a constant light absorption rate, such that the sensitivity may be reduced.

The layer thickness of the light to heat converting layer is preferably from 0.03 to 0.8 μm, and is more preferably from 0.05 to 0.3 μm.

Further, it is preferable that the light to heat converting layer has a maximum absorbance (optical density) within the range of from 0.1 to 1.3 (preferably, from 0.2 to 1.1) in the wavelength region of from 700 to 2000 nm.

Heat Sensitive Peeling Layer

A heat sensitive peeling layer which includes a heat sensitive material can be provided on the light to heat converting layer of the thermal transfer material. The heat sensitive peeling layer generates gas or discharges water applied thereto due to the action of heat which was generated at the light to heat converting layer. In this way, the heat sensitive peeling layer weakens the bonding strength between the light to heat converting layer and the image forming layer.

The above heat sensitive material can use a compound (polymer or low molecular compound) which itself decomposes or is altered by heat and generates gas, a compound (polymer or low molecular compound) which absorbs a considerable amount of liquefied gas such as water, or the like. Or, a combination of such compounds may be used.

Examples of the polymer which decomposes or is altered by heat and generates gas are an auto-oxidizable polymer such as nitro cellulose or the like; a halogen-containing polymer such as chlorinated polyolefin, chlorinated rubber, polyvinyl chloride, polyvinylidene chloride, or the like; an acrylic polymer, such as polyisobutyl methacrylate or the like, which absorbs a volatile compound such as water or the like; cellulose ester, such as ethyl cellulose or the like, which absorbs a volatile compound such as water or the like; and a natural high molecular compound, such as gelatin or the like, which absorbs a volatile compound such as water or the like. Examples of the low molecular compound which decomposes or is altered by heat and generates gas are compounds, such as a diazo compound, an azide compound, and the like, which generate gas by exothermic decomposition. The above-described decomposition, alteration, or the like of the heat sensitive material by heat preferably occurs at 280° C. or less, and particularly preferably occurs at 230° C. or less.

When the low molecular compound is used as the heat sensitive material, it is desirable that the compound is combined with a binder. As the binder, the above polymer which itself decomposes or is altered by heat and an ordinary polymer binder which does not have such characteristics can be used.

When the heat-sensitive low molecular compound and the binder are used in combination, the mass ratio of the former to the latter is preferably from 0.02:1 to 3:1, and is more preferably from 0.05:1 to 2:1.

It is preferable that substantially the entire surface of the light to heat converting layer is covered with the heat sensitive peeling layer. The layer thickness of the heat sensitive peeling layer is, in general, from 0.03 to 1 $\mu$m, and above all, is preferably from 0.05 to 0.5 $\mu$m.

In case of the thermal transfer material having a structure in which the light to heat converting layer, the heat sensitive peeling layer, and the image forming layer are superposed on the supporting body in that order, the heat sensitive peeling layer decomposes and is altered by the heat which is transmitted from the light to heat converting layer, and generates gas. Then, due to the decomposition or the generation of gas, a portion of the heat sensitive peeling layer disappears, or alternatively, cohesive failure occurs within the heat sensitive peeling layer. The bonding strength between the light to heat converting layer and the image forming layer is thereby lowered. As a result, depending on the behavior of the heat sensitive peeling layer, a portion thereof may adhere to the image forming layer and appear on the surface of an ultimately formed image. Thus, color mixing of the image may occur.

Therefore, it is desirable that the heat sensitive peeling layer is hardly colored (i.e., exhibits high permeability with respect to visible light) so that, even if transfer of the heat sensitive peeling layer occurs, color mixture does not appear visually on the formed image. More specifically, the light absorption rate of the heat sensitive peeling layer is, with respect to visible light, preferably 50% or less and is more preferably 10% or less.

Instead of providing an independent heat sensitive peeling layer, the light to heat converting layer may be a heat sensitive peeling layer as well as the light to heat converting layer by adding the heat sensitive material to the light to heat converting layer.

Cushion Layer

In order to improve the adhesion to the surface of the image receiving layer of the image receiving material, it is preferable that a cushion layer is provided between the supporting body and the light to heat converting layer of the thermal transfer material as an intermediate layer having cushioning ability.

The above-described cushion layer is a layer which is easily deformed when stress is applied to the image forming layer. The cushion layer has the effect of improving the adhesion between the image forming layer and the image receiving layer at the time of laser thermal transfer and an effect of improving the image quality. Moreover, even if foreign matter enters between the thermal transfer material and the image receiving material, due to the deformation action of the cushion layer, the space between the image receiving layer and the image forming layer is reduced. As a result, the cushion layer has the effect of reducing the size of image void defects. Further, when an image is once transferred and formed and then transferred onto a printing paper or the like which is separately prepared, the image receiving surface deforms in response to the convexoconcave surface of the paper. Accordingly, by improving the transferability of the image receiving layer, and further, by lowering the gloss of the object to be transferred, the cushion layer can also have the effect of improving the resemblance of the ultimately obtained image with the initial printed matter.

In order to impart cushioning ability, a material having a low modulus of elasticity, a material having rubber elasticity, or a thermoplastic resin which is easily softened by heating may be used.

The modulus of elasticity is preferably from 10 to 500 kgf/cm$^2$ at room temperature, and is more preferably from 30 to 150 kgf/cm$^2$ thereat.

Further, in order to immerse a foreign object such as a rubber or the like, penetration (25° C., 100 g, 5 seconds) which is defined in JIS K2530 is preferably 10 or more.

Moreover, the glass transition temperature of the cushion layer is 80° C. or less, and is preferably 25° C. or less. In order to adjust the physical properties, e.g., Tg, a plasticizer can be added into the polymer binder suitably.

In addition to rubbers such as a urethane rubber, a butadiene rubber, a nitrile rubber, acrylic rubber, a natural rubber, or the like, the binder which forms the cushion layer may be, for example, polyethylene, polypropylene, polyester, styrene-butadiene copolymer, ethylene-vinyl acetate copolymer, ethylene-acrylic copolymer, vinyl chloride-vinyl acetate copolymer, vinylidene chloride resin, vinyl chloride resin containing plasticizer, polyamide resin, phenol resin, or the like.

The layer thickness of the cushion layer differs in accordance with the conditions of the resin to be used or the like. Usually, the layer thickness is preferably from 3 to 100 $\mu$m, and is more preferably from 10 to 50 $\mu$m.

Supporting Body

The supporting body which can be used for the thermal transfer material is not limited in particular, and various supporting body materials can be selected appropriately in response to the purpose.

Examples of the supporting body material include synthetic resin materials such as polyethylene terephthalate, polyethylene-2,6-naphthalate, polycarbonate, polyethylene, polyvinyl chloride, polyvinylidene chloride, polystyrene, styrene-acrylonitrile copolymer, and the like. Among them, biaxially oriented polyethylene terephthalate is preferable from the point of dimensional stability With respect to mechanical strength or heat. When the thermal transfer material is used for preparing a color proof which utilizes laser recording, the supporting body is preferably a transparent synthetic resin material, through which a laser light permeates.

Further, an undercoat layer, which is subjected to a surface activating processing and/or is one layer or two layers or more, may be provided at the above supporting body for the purpose of improving adhesion to the light to heat converting layer which is provided thereon.

The above surface activating processing includes, for example, a glow discharge processing, a corona discharge processing, or the like.

The material for the above undercoat layer is preferably a material which provides both surfaces of the supporting body and the light to heat converting layer with a high adhesive property, has low thermal conductivity, and has excellent heat resistance. Examples of the material for the undercoat layer include styrene, styrene-butadiene copolymer, gelatin, or the like. The layer thickness of the undercoat layer is usually from 0.01 to 2 $\mu$m.

Further, the surface of the supporting body, at which the light to heat converting layer is not provided, can be provided with various functional layers, such as an antireflection layer and the like, as occasion demands, or can be subjected to a surface processing.

Image Forming Material

An image forming material is formed by the thermal transfer material of the present invention and the image receiving material. The above-described image receiving material has an image receiving layer on a supporting body. The supporting body of the image receiving material may be the same as that of the above thermal transfer material or may be separate and independent therefrom. There is an aspect in which the image receiving material is formed by having other layers, such as an undercoat layer, a cushion layer, a peeling layer, an intermediate layer, and the like, between the supporting body and the image receiving layer. Further, the image receiving material may have a back layer on the surface which is opposite the side at which the image receiving layer is provided. In order to improve the conveying ability and the stacking ability, or when the image receiving material is taken up in a roll shape, or the like, it is preferable to have the back layer from the point of roughening the surface of the image receiving layer. Moreover, it is also preferable that an antistatic layer is provided separately from the layers, or that an antistatic agent is added to the above respective layers.

An aspect in which the above image receiving layer has at least a cushion layer and an image receiving layer on the supporting body and in which the above supporting body has a void is preferable.

Image Receiving Layer

The above-described image receiving layer is a layer which is formed by having an organic polymer binder as a principal component.

The above organic polymer binder (hereinafter, the organic polymer binder may be referred to as "image receiving layer binder polymer") is preferably a thermoplastic resin. Examples of the organic polymer binder include a homopolymer of acrylic monomer and a copolymer thereof such as acrylic acid, methacrylic acid, acrylic ester, methacrylic ester, or the like; cellulose polymer such as methyl cellulose, ethyl cellulose, cellulose acetate, or the like; a homopolymer of vinyl monomer and a copolymer thereof such as polystyrene, polyvinyl pyrrolidone, polyvinyl butyral, polyvinyl alcohol, polyvinyl chloride, or the like; a condensed polymer such as polyester, polyamide, or the like; and a rubber polymer such as butadiene-styrene copolymer or the like.

From the standpoint of obtaining moderate adhesive strength with the image forming layer, the image receiving layer binder polymer is preferably a polymer whose glass transition temperature (Tg) is lower than 90° C. To this end, a plasticizer can be added to the image receiving layer. Further, for the purpose of preventing blocking between the sheets, the Tg of the image receiving layer binder polymer is preferably 30° C. or higher.

From the standpoint of improving the adhesion to the image forming layer of the thermal transfer material and improving the sensitivity or the image strength at the time of laser recording, it is especially preferable that the above image receiving layer binder polymer uses the same or a similar polymer as the binder polymer which is used for the image forming layer.

The layer thickness of the above image receiving layer is preferably from 0.3 to 7 $\mu$m, and is more preferably from 0.7 to 4 $\mu$m.

If the above layer thickness is less than 0.3 $\mu$m, when retransfer is carried out onto a printing paper, the film is insufficient in strength and is easily torn. If the layer thickness is more than 7 $\mu$m, the gloss of the image after retransfer onto the paper increases and resemblance of the ultimately obtained image with the initial printed matter may deteriorate.

The above plasticizer used can be the same as the aforementioned plasticizer which is usable for the image forming layer of the thermal transfer material.

Supporting Body

The supporting body which is used for the image receiving material is generally a sheet-shaped base material such as a plastic sheet, a paper, a metallic sheet, a glass sheet, or the like.

Examples of the plastic sheet include sheets of polyethylene terephthalate, polyethylene naphthalate, polyethylene, polycarbonate, polyvinyl chloride, polyvinylidene chloride, polystyrene, or the like. Among them, in particular, a polyethylene terephthalate sheet is preferable.

Examples of the above paper include a printing paper, a coat paper, or the like.

Further, as the supporting body, a white material having a void inside is preferable from the standpoint of cushioning ability, visibility of an image, and the like. In particular, an expanded polyester supporting body is most preferable from the standpoint of mechanical characteristics.

Moreover, for the purpose of enhancing the adhesion to the image receiving layer, the surface of the supporting body may be subjected to a surface processing such as a corona discharging processing, a glow discharging processing, or the like.

The thickness of the above supporting body is usually from 10 to 400 $\mu$m, and is particularly preferably from 25 to 200 $\mu$m.

Back Layer

For the purpose of roughening the surface of the image receiving layer and improving the conveying ability within the recording device, additives such as particulates of silicon oxide, a surface active agent, an antistatic agent of tin oxide particulates, or the like may be added to the above back layer.

The additives can be added not only to the back layer but also to other layers including the image receiving layer as occasion demands.

Examples of the above particulates include inorganic particulates of silicon oxide, calcium carbonate, titanium dioxide, aluminum oxide, zinc oxide, barium sulfate, zinc sulfate, or the like; organic particulates which are formed by resins, such as a polyethylene resin, a silicon resin, a fluoroethylene resin, an acrylic resin, a methacrylic resin, a melamine resin, or the like; and the like. Among them, titanium dioxide, calcium carbonate, silicon oxide, a silicon resin, an acrylic resin, and a methacrylic resin are preferable. The average particle size of the above particulates is preferably from 0.5 to 10 $\mu$m, and is more preferably from 0.8 to 5 $\mu$m.

The content of the above particulates is preferably from 0.5 to 80% by mass based on the total solid content mass of the back layer or the image receiving layer, and is more preferably from 1 to 20% by mass.

Further, the above antistatic agent can be selected and used appropriately from various types of surface active agents and conductive agents so that the surface resistance of the layer is $10^{12}$ Ω or less, and is more preferably $10^{9}$Ω under the environmental conditions of 23° C. and 50% RH.

As described above, examples of the image receiving layer are (1) an aspect of having the image receiving layer on the supporting body, and (2) an aspect of having the image receiving layer on the one surface of the supporting body and having the back layer including particulates on the other surface thereof. However, the present invention is not limited to the same, and the following aspects are possible. Namely, the image receiving material may be:

(3) an aspect which is formed by providing a cushion layer between the supporting body and the image receiving layer; or (4) an aspect in which particulates which are the same as those used in the above back layer are further included in the image receiving layer of the above-described aspect (3).

In case of the above aspects (2) to (4), by taking up the image receiving material in a roll shape, the surface of the image receiving material can be roughened by the pressing force of the back layer including particulates.

Moreover, as in the above aspects (3) and (4), by providing the cushion layer as an intermediate layer of the image receiving layer, adhesion failure which occurs when the surface of the image receiving layer is rough can be prevented. Thus, these aspects are also applicable to the present invention.

Cushion Layer

For the purpose of improving the adhesion of the image forming layer of the thermal transfer material to the surface of the image receiving layer, it is preferable that a cushion layer is provided between the supporting body and the image receiving layer of the image receiving material as an intermediate layer having cushioning ability.

The structural components which can be used for the above cushion layer can be the same as those of the cushion layer which is formed at the above thermal transfer material, and the above cushion layer can have the same structure as the cushion layer formed at the thermal transfer material.

It is necessary that the image receiving layer and the cushion layer be adhered together until the stage of laser recording. However, in order to transfer the image onto the printing paper, it is preferable that the image receiving layer and the cushion layer are provided so as to be peelable. In order to facilitate peeling, a peeling layer having a thickness of approximately from 0.1 to 2 $\mu$m is preferably provided between the cushion layer and the image receiving layer.

It is preferable that the peeling layer functions as a barrier to the application solvent when solvent is applied to the image receiving layer.

As the structure of the image receiving material, an example in which the supporting body/the cushion layer/the image receiving layer are superposed is shown. However, in some cases, there may be a structure in which the image receiving layer also has a cushioning ability, i.e., a structure of a supporting body/an image receiving layer having a cushioning ability, or a structure of a supporting body/an undercoat layer/ an image receiving layer having a cushioning ability. In this case as well, it is preferable that the image receiving layer having a cushioning ability is provided peelably so that retransfer of an image to the printing paper is possible. In this case, an image which is retransferred onto the printing paper is an image having excellent gloss.

The layer thickness of the cushion layer which also serves as an image receiving layer is preferably from 5 to 100 $\mu$m, and is more preferably from 10 to 40 $\mu$m.

When the image is temporarily formed on the image receiving layer and thereafter is retransferred onto a printing paper or the like, it is also preferable that at least one layer of the image receiving layer is formed from a photo-curing material.

The composition of the photo-curing material may be, for example, a combination which is formed by a) a photopolymerization monomer which is formed by at least one of a multifunctional vinyl compound or a multifunctional vinylidene compound which can form a photopolymer by addition polymerization, b) an organic polymer, and c) additives such as a photopolymerization initiator, and as occasion demands, a polymerization inhibitor or the like.

The above multifunctional vinyl monomer includes unsaturated esters of polyol, in particular, acrylic ester or methacrylic ester (e.g., ethylene glycol diacrylate, pentaerythritol tetraacrylate).

Examples of the organic polymer are the same as the above examples of the image receiving layer binder polymer.

Examples of the above photopolymerization initiator include ordinary photoradical polymerization initiators such as benzophenone, Michler's ketone, or the like. The photopolymerization initiator can be used in an amount of from 0.1 to 20% by mass based on the total solid content mass in the layer.

When the above cushion layer is provided, for the purpose of preventing immersion of particulates when the back layer having a rough surface or the image receiving layer contains the particulates, an intermediate layer which is hardly deformed when stress is applied thereto can be provided. It is necessary that the layer uses a material which enables application to the cushion layer. The layer can be formed by containing a polymer having a comparatively high glass transition point, such as PMMA, polystyrene, cellulose triacetate, or the like.

Explanation will be given of a laser thermal transfer recording method in which image recording is carried out using the image forming material of the present invention.

The laser thermal transfer recording method is effected as follows. A superposed body, in which the image receiving material is superposed on the surface of the image forming layer of the thermal transfer material so that the image receiving layer abuts thereto, is prepared. Laser light is illuminated imagewise in time sequence onto the surface from the upper side of the thermal transfer material of the superposed body (the supporting body side of the thermal transfer material). Thereafter, the image receiving material and the thermal transfer material are peeled, such that the image receiving material, onto which the laser illuminated region of the above image forming layer was transferred, is obtained.

There are various methods of forming the above superposed body. For example, since it is unnecessary to control the temperature of a heat roller or the like and adhesion and superposition can be effected quickly and uniformly, a vacuum adhering method may be used.

In this case, the surface roughness may be decreased for the purpose of enhancing the adhesion as described above. However, it is impossible to reduce the pressure at high speed at the time of vacuumizing. Conversely, if the surface roughness is increased in order to carry out the vacuumizing at high speed, the degree of reduced pressure on the adhering surface between the image receiving layer of the image receiving material and the image forming layer of the thermal transfer material which contact each other improves. However, there are a number of micro voids on the contact surfaces, and accordingly, the thermal conductivity is inhibited and the transferability may be reduced.

In order to obtain appropriate adhesion for the image recording, it is preferable that the layer surface configuration on the adhering surface changes as the degree of reduced pressure on the adhering surface increases and that the image receiving layer and the image forming layer are in a completely and uniformly adhered state. Therefore, it is useful to provide the cushion layer at the thermal transfer material and/or the image receiving material from the point of improving transferability and forming an image having high image quality.

Moreover, in addition to the above vacuum adhering method, as another method of forming a superposed body, for example, a method in which the transferring side (image forming layer side) of the thermal transfer material and the image receiving side (image receiving layer side) of the image receiving material are superposed, pressurized, and conveyed through heat rollers is also preferable. In this case, the heating temperature is 160° C. or less, or more preferably 130° C. Further, a method in which the image receiving material is mechanically adhered onto a metal drum while pulling the image receiving material, and further, the thermal transfer material is mechanically adhered onto the image receiving material in the same manner while pulling the thermal transfer material is also preferable. Among the aforementioned, the vacuum adhering method is particularly preferable.

The adhesion between the thermal transfer material and the image receiving material may be carried out immediately before the laser light illuminating operation.

In the case of the vacuum adhering method, usually, the image receiving material side of the above superposed body is adhered by vacuumizing to the surface of a recording drum (rotating drum which has a vacuum forming mechanism inside and has a number of minute opening portions on the surface of the drum), the thermal transfer material which is larger than the image receiving material is superposed so as to cover the entire image receiving material, the pressure of the contact interfaces is reduced by vacuumizing, and the contact interfaces are adhered. The laser light illuminating operation is effected in this state by illuminating a laser light from the outer side of the superposed body, i.e., from above the thermal transfer material side. The illumination of the laser light is scaned so as to move reciprocally in the transverse direction of the drum, and the recording drum is rotated at a constant rotating speed during the illuminating operation.

The laser thermal transfer recording method can be utilized for manufacturing a black mask or forming a monochromatic image and can be also utilized advantageously for forming a polychromatic image. A method of forming a polychromatic image may be, for example, the aspects described below.

Namely, a first aspect of the method of forming a polychromatic image is effected as follows. The image receiving material is fixed onto the rotating drum of a recording device in accordance with a vacuum reduced pressure method. The thermal transfer material is superposed in the same way on the image receiving material in accordance with the vacuum reduced pressure method so that the image receiving layer and an image recording layer (hue 1) of the thermal transfer material contact. Next, a laser light which was modulated on the basis of a digital signal of the color separated image of a document image is illuminated from the supporting body side of the thermal transfer material while rotating the drum. Thereafter, the thermal transfer material is peeled from the image receiving material in a state in which the image receiving material is fixed. The thermal transfer materials having a hue 2, a hue 3, and a hue 4, as occasion demands, are superposed on the image receiving material, on which the image having a hue 1 was recorded, in accordance with the same method as described above. Then, the processes of laser recording and peeling are repeated sequentially. Accordingly, the image receiving material, on which a polychromatic image is formed by the above processes, can be obtained. In order to obtain a color proof image on a printing paper, the image receiving material, on which the polychromatic image was formed by the above processes, is superposed so that the image surface contacts the printing paper. Then, the image receiving material is heated through a laminater or the like, pressurized, and further, peeled. The image is transferred onto the printing paper with the image receiving layer, such that the color proof image can be obtained.

A second aspect of the method of forming a polychromatic image is carried out as follows. Each thermal transfer material has an image forming layer which contains a coloring agent having a different hue. The thermal transfer materials are superposed, such that superposed bodies are formed. Three types (three colors) or four types (four colors) of superposed bodies are independently prepared. Each superposed body is subjected to laser illumination on the basis of the digital signal of each color image which is obtained through a color separation filter and which corresponds to each superposed body. Thereafter, the thermal transfer material and the image receiving material are peeled. The color separated image of each color is independently formed a corresponding image receiving material. Then, each color separated image is successively superposed on an actual supporting body, such as a printing paper or the like, which is separately prepared or a supporting body which is similar to the actual supporting body. Accordingly, an image can be formed.

Examples of the laser light source which is used for the above image recording include a gas laser such as an argon ion laser, a helium neon laser, a helium cadmium laser, or the like; a solid state laser such as a YAG laser light or the like; a direct laser such as a semiconductor laser, a dye laser, an excimer laser, or the like; or a laser in which these lasers are converted into lasers whose wavelengths are halved through a secondary harmonic element. Among the aforementioned, a multimode semiconductor laser is preferable from the viewpoint of high output and high speed image formation, and a refractive index wave guiding type lateral multimode semiconductor laser is particularly preferable.

Further, in the laser thermal transfer recording method using the laser thermal transfer material of the present invention, it is preferable that the laser illumination is carried out under the condition in which the beam diameter on the light to heat converting layer is from 3 to 50 $\mu$m, and more preferably from 7 to 30 $\mu$m.

In accordance with the above laser thermal transfer recording method, even if the laser is used for the image recording, an image having high image density and high quality can be formed at high speed without having a harmful effect caused by thermal decomposition of the coloring agent.

EXAMPLES

The present invention will be described hereinafter in accordance with Examples. However, the present invention is not limited to these Examples at all. It should be noted that all instances of "part" and "%" in the Examples denote "part by mass" and "% by mass".

Example 1

Preparation of Thermal Transfer Material

Formation of Light to Heat Converting Layer

The following respective components were mixed by a stirrer while heating and stirring were carried out. An application solution for a light to heat converting layer was prepared.

| Composition of Application Solution | |
|---|---|
| methyl ethyl ketone | 800 parts |
| N-methyl-2-pyrrolidone | 1200 parts |
| surface active agent ("F-177" manufactured by Dainippon Ink & Chemicals, Inc.) | 1 parts |
| infrared absorption dye ("NK-2014" manufactured by Nippon Photosensitive Dye, Inc.) | 10 parts |
| polyimide ("RIKACOAT SN-20" manufactured by New Japan Chemical Co., Ltd.) | 200 parts |

The above application solution was applied onto one surface of a polyethylene terephthalate film having a thickness of 75 $\mu$m using a rotating applying machine (whirler). Thereafter, the film to which the solution was applied was dried in a oven of 100° C. for 2 minutes, and a light to heat converting layer was formed on the supporting body. The obtained light to heat converting layer had maximum absorption in the vicinity of a wavelength of 810 nm. When the absorbance was measured by a spectrophotometer, OD was 1.0. The membrane thickness was 0.3 $\mu$m.

| Formation of Image Forming Layer | |
|---|---|
| Respective mother liquors of the following compositions were prepared. | |
| mother liquor for a cyan image forming layer | |
| polyvinyl butyral resin ("DENKA BUTYRAL #2000-L" manufactured by Denki Kagaku Kogyo K.K., Vicat softening point of 57° C.) | 12 parts |
| cyan pigment (C. I. Pigment Blue 15:4 | 15 parts 100% by mass) |
| dispersing aid ("SOLSPAS S-2000" manufactured by ICI Japan) | 0.8 parts |
| solvent (n-propanol) | 110 parts |
| mother liquor for a magenta image forming layer | |
| polyvinyl butyral resin ("DENKA BUTYRAL #2000-L" manufactured by Denki Kagaku Kogyo K.K., Vicat softening point of 57° C.) | 15 parts |
| magenta pigment (C. I. Pigment Red 57:1 (illustrative compound (1)-1 | 15 parts 13.5 parts) 1.5 parts) |
| dispersing aid ("SOLSPAS S-2000" manufactured by ICI Japan) | 0.8 parts |
| solvent (n-propanol) | 110 parts |
| mother liquor for a yellow image forming layer | |
| polyvinyl butyral resin ("DENKA BUTYRAL #2000-L" manufactured by Denki Kagaku Kogyo K.K., Vicat softening point of 57° C.) | 12 parts |
| yellow pigment (C.I. Pigment Yellow 14 | 15 parts 100 % by mass) |
| dispersing aid ("SOLSPAS S-2000" manufactured by ICI Japan) | 0.8 parts |
| solvent (n-propanol) | 110 parts |

-continued

| Formation of Image Forming Layer | |
|---|---|
| mother liquor for a black image forming layer | |
| polyvinyl butyral resin ("DENKA BUTYRAL #2000-L" manufactured by Denki Kagaku Kogyo K.K., Vicat softening point of 57° C.) | 12 parts |
| black pigment ("MA-100" manufactured by Mitsubishi Kasei Corp. 100% by mass) | 15 parts |
| dispersing aid ("SOLSPAS S-2000" manufactured by ICI Japan) | 0.8 parts |
| solvent (n-propanol) | 110 parts |

0.24 parts of amide stearate, 0.24 parts of rosin resin ("ROSIN KE 311" manufactured by Arakawa Chemical Industries, Ltd.), 0.4 parts of the above polyvinyl butyral resin, 0.045 parts of a surface active agent ("F-177" manufactured by Dainippon Ink & Chemicals, Inc.), and 100 parts of n-propanol were added to 10 parts of each of the above-prepared mother liquors. Accordingly, respective application solutions were prepared. The application solutions for cyan, magenta, yellow, and black image forming layers were applied onto the above-formed light to heat converting layer in that order, such that respective image forming layers were formed. The membrane thickness (dry membrane thickness) of the cyan image forming layer was 0.4 μm, the membrane thickness of the magenta image forming layer was 0.4 μm, the membrane thickness of the yellow image forming layer was 0.4 μm, and the membrane thickness of the black image forming layer was 0.35 μm Examples 2 to 5

Except that compositions of a magenta image forming layer were replaced as shown in the following Table 1, thermal transfer materials were prepared in the same way as in Example 1.

Comparative Example 1

Except that 13.5 parts of C.I. Pigment Red 5:7:1 and 1.5 parts of C.I. Pigment Orange 13 were used and the illustrative compound (1)-1 of Example 1 was not used as a magenta pigment, a thermal transfer material was prepared in the same way as in Example 1.

Preparation of Image Receiving Material

An application solution for a cushion layer having the following composition and an application solution for an image receiving layer having the following composition were prepared.

| Composition of Application Solution for Cushion Layer | |
|---|---|
| SOLPAIN CL2 (manufactured by Nissin Kagaku, K.K.; copolymer of vinyl chloride and vinyl acetate) | 15.1 parts |
| PARAPREX G40 (manufactured by CP. HALL. COMPANY) | 16.9 parts |
| MEGAFACK F178K (manufactured by Dainippon Ink & Chemicals, Inc.; fluorine surface active agent) | 0.5 parts |
| MEK | 51.3 parts |
| toluene | 13.7 parts |
| dimethyl formamide | 2.5 parts |

-continued

| Composition of Application Solution for Cushion Layer | |
|---|---|
| Preparation of Application Solution for Image Receiving Layer | |
| ESLECK BLSH (manufactured by Sekisui Chemical Co., Ltd.; polyvinyl butyral) | 7.9 parts |
| MEGAFACK F176PF (manufactured by Dainippon Ink & Chemicals, Inc.; fluorine surface active agent) | 0.1 parts |
| n-propyl alcohol | 22.8 parts |
| MFG | 20.9 parts |
| methanol | 48.3 parts |

The above-obtained application solution for a cushion layer was applied onto a PET base (thickness of 100 μm) by an extrusion type applicator so that the dry layer thickness was 18 μm. The PET base was dried and then a cushion layer was formed.

Next, the above application solution for an image receiving layer was applied onto the formed cushion layer using the extrusion type applicator so that the dry layer thickness was 2 μm. The image receiving layer was dried and formed, such that an image receiving material (1) was obtained.

Image Recording

The above-obtained image receiving material (1) (25 cm×35 cm) was trained around and sucked to a rotating drum, which had a diameter of 25 cm and in which vacuum suction holes (surface density: one in an area of 3 cm×3 cm) each having a diameter of 1 mm were provided. Next, the thermal transfer material of Example 1, which had been cut to 30 cm×40 cm, was superposed on the above image receiving material (1) so that the thermal transfer material uniformly jutted out over and covered the image receiving material (1). While squeezing by a squeeze roller, the thermal transfer material and the image receiving layer (1) were adhered so that air was absorbed into the suction holes. Accordingly, a superposed body was formed. A degree of reduced pressure in a state in which the suction holes were closed was −150 mm Hg with respect to one atmospheric pressure.

The above-described drum was rotated. By TC-P1080 (manufactured by Dainippon Screen Mfg. Co., Ltd.), the surface of the superposed body on the drum was illuminated so that a semiconductor laser light having a wavelength of 830 nm (illumination energy on the surface of the supporting body of the laser thermal transfer material was 300 mJ/cm$^2$) was converged onto the surface of the light to heat converting layer from the supporting body side of the thermal transfer material of Example 1. While the superposed body was moved in an normal direction (sub-scanning direction) relative to the rotating direction (main scanning direction) of the rotating drum, recording was carried out imagewise.

The superposed body, which had been subjected to the laser image recording as described above, was removed from the drum, and the thermal transfer material of Example 1 and the image receiving material (1) were peeled. It was confirmed that the image forming layer of the laser illuminated portion was transferred onto the image receiving material (1) and that a good image was formed.

The sensitivity, the resolving power, and the hue of the formed image of the thermal transfer material of Example 1 were evaluated as follows.

Evaluation of Sensitivity

The transferred image was observed by a light microscope, and the line width of the recorded lines was measured. E, which was calculated from the following formula, was obtained, and the value of E was evaluated based on the following criteria. The following Table 1 shows the results. The smaller the E, the higher the sensitivity.

$$E=(\text{laser power } P)/(\text{line width } d \times \text{line velocity } v)$$

⊙: E was 400 mJ/cm$^2$ or less (line width of 7 μm or more), and sensitivity was high.

○: E was from more than 400 to 450 mJ/cm$^2$ or less (line width of from 6 μm or more to less than 7 μm), and sensitivity was good.

Δ: E was from more than 450 to 550 mJ/cm$^2$ or less (line width of from 5 μm or more to less than 6 μm), and sensitivity was slightly low.

X: E was more than 550 mJ/cm$^2$, and sensitivity was low.

Evaluation of Resolution

In the same way as described above, the lines which were laser-recorded were evaluated visually in accordance with the following criteria. The following Table 1 shows the results of evaluation.

Criteria

○: both vertical and horizontal lines did not have indentations and were clear lines X: both vertical and horizontal lines had indentations, and a portion of the transferred image forming layer was peeled.

Evaluation of Image Hue

The hue of the obtained image was observed visually and compared with the hues of Japan Colour Standard Colour Sample (Ver. 2), and the difference in hues was evaluated functionally in accordance with the following criteria. The following Table 1 shows the results of evaluation.

Criteria

○: The hue of the formed image was a hue which was substantially the same as the standard color sample.

Δ: The hue of the formed image was slightly different from the standard color sample, however, the hue was good for actual use.

X: The hue of the formed image was greatly different from the standard color sample.

Further, the existence of generation of benzidine at the time of formation of the image was checked in the following manner.

First, using the thermal transfer material of Example 1, a solid image was printed by a laser. Thereafter, 0.24 m$^2$ of a magenta image forming layer was trimmed, was subjected to methanol extraction, was concentrated at constant volume of 1 milliliter. A sample solution was thereby obtained. The sample solution was measured by a gas chromatograph mass spectrometer (GC-MS), and MS m/z=200 (molecular weight of benzidine) was subjected to selected ion detection. As shown in the following Table 1, benzidine was not detected in the thermal transfer material of Example 1.

For the thermal transfer materials of Examples 2 to 5 and Comparative Example 1, the sensitivity, the resolution, the hue, and the existence of generation of benzidine were evaluated in the same way as in Example 1. The following Table 1 shows the results of evaluation.

TABLE 1

| | Magenta Image Forming Layer | | | Evaluation | | | |
|---|---|---|---|---|---|---|---|
| | ①Main Pigment | ②Assistant Pigment | ①/② Mass Ratio | Sensitivity | Resolution | Hue | Existence of Generation of Benzidine |
| Example 1 | C.I.P.R. D.57:1 | Illustrative Compound (1)-1 | 90/10 | ⊙ | ○ | ○ | None |
| Example 2 | C.I.P.R. 57:1 | Illustrative Compound (1)-2 | 90/10 | ○ | ○ | Δ | None |
| Example 3 | C.I.P.R. 57:1 | Illustrative Compound (1)-3 | 90/10 | ○ | ○ | Δ | None |
| Example 4 | C.I.P.R. 57:1 | Illustrative Compound (1)-1 | 60/40 | ○ | ○ | Δ | None |
| Example 5 | C.I.P.R. 57:1 | Illustrative Compound (2)-1 | 90/10 | ○ | ○ | Δ | None |

TABLE 1-continued

| | Magenta Image Forming Layer | | | Evaluation | | | |
|---|---|---|---|---|---|---|---|
| | ①Main Pigment | ②Assistant Pigment | ①/② Mass Ratio | Sensitivity | Resolution | Hue | Existence of Generation of Benzidine |
| Comparative Example 1 | C.I.P.R. 57:1 | C.I 21110 Pigment Orange | 90/10 | ⊙ | ○ | Δ | Detected |

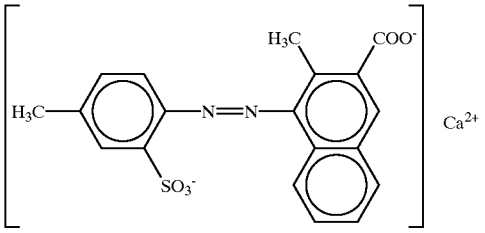

C. I. P.R. 57:1

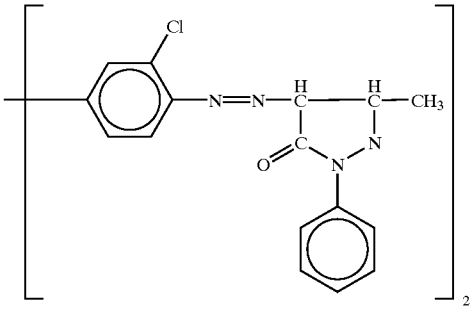

C. I. 21110
Pigment Orange 13

In accordance with the present invention, a thermal transfer material and an image forming material, in which decomposition of a coloring agent hardly occurs at the time of forming an image, and which is highly safe, and which can form a vivid image having good hue, can be provided.

What is claimed is:

1. A thermal transfer material which has at least a light to heat converting layer and an image forming layer on a supporting body, wherein the image forming layer contains at least one compound which is selected from compounds which are represented by following general formula (1) and following general formula (2):

General Formula (1)

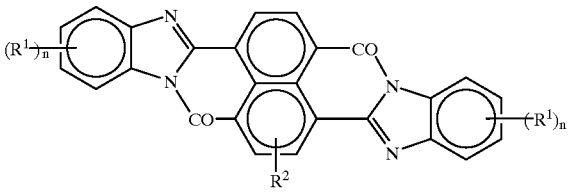

wherein, $R^1$ represents one of a hydrogen atom, an alkyl group having 1 to 5 carbon atoms, a halogen atom, and an alkoxy group having 1 to 5 carbon atoms;

$R^2$ represents one of a hydrogen atom and an alkyl group having 1 to 5 carbon atoms; and n represents any integer of from 1 to 4;

General Formula (2)

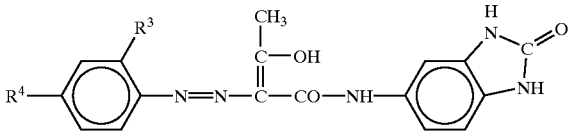

wherein, $R^3$ and $R^4$ respectively and independently represent one of a nitro group, a halogen atom, a methylsulfonyl group, and a cyano group.

2. A thermal transfer material according to claim 1, wherein $R^1$ and $R^2$ in general formula (1) are hydrogen atoms.

3. A thermal transfer material according to claim 1, wherein in general formula (2), $R^3$ is a nitro group and $R^4$ is a chlorine atom.

4. A thermal transfer material according to claim 1, wherein n in general formula (1) is one of 1 and 2.

5. A thermal transfer material according to claim 1, wherein the image forming layer further contains a pigment, and the contained amount of compound which is selected from the compounds represented by general formula (1) and general formula (2) is 30% by mass or less based on the contained amount of the pigment.

6. A thermal transfer material according to claim 5, wherein the contained amount of compound which is selected from the compounds represented by general formula (1) and general formula (2) is from 5% by mass or more to 15% by mass or less based on the contained amount of the pigment.

7. A thermal transfer material according to claim 5, wherein the pigment is a magenta pigment.

8. A thermal transfer material according to claim 7, wherein the sum of the contained amount of the pigment and the contained amount of compound which is selected from the compounds represented by general formula (1) and general formula (2) is from 30% by mass to 70% by mass of the solid components in the image forming layer.

9. A thermal transfer material according to claim 7, wherein the sum of the contained amount of the pigment and the contained amount of compound which is selected from the compounds represented by general formula (1) and general formula (2) is from 30% by mass to 40% by mass of the solid components in the image forming layer.

10. A thermal transfer material according to claim 1, wherein the light to heat converting layer contains a heat resistant resin which has a glass transition temperature of from 200° C. or more to 400° C. or less and which has a thermal decomposition temperature of 450° C. or more.

11. A thermal transfer material according to claim 10, wherein the heat resistant resin is an organic solvent soluble polyimide resin.

12. A thermal transfer material according to claim 1, wherein the light to heat converting layer contains an infrared absorbing dye.

13. A thermal transfer material according to claim 1, wherein the image forming layer contains from 30 to 70% by mass of an amorphous polymer which has a softening point of from 40° C. or more to 150° C. or less.

14. A thermal transfer material according to claim 1, wherein the film thickness of the image forming layer is from 0.2 μm or more to 1.5 μm or less.

15. An image forming material which is formed by a thermal transfer material and an image receiving material, wherein said thermal transfer material has at least a light to heat converting layer and an image forming layer on a supporting body, and the image forming layer contains at least one compound which is selected from compounds which are represented by following general formula (1) and following general formula (2), and the image receiving material having an image receiving layer on a supporting body:

General Formula (1)

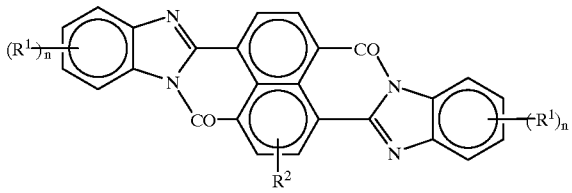

wherein, $R^1$ represents one of a hydrogen atom, an alkyl group having 1 to 5 carbon atoms, a halogen atom, and an alkoxy group having 1 to 5 carbon atoms;

$R^2$ represents one of a hydrogen atom and an alkyl group having 1 to 5 carbon atoms; and n represents any integer of from 1 to 4;

General Formula (2)

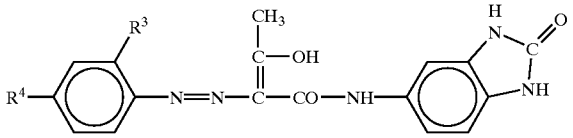

wherein, $R^3$ and $R^4$ respectively and independently represent one of a nitro group, a halogen atom, a methylsulfonyl group, and a cyano group.

16. An image forming material according to claim 15, wherein the image receiving material further has a cushion layer, and the supporting body has a void.

17. A laser thermal transfer recording method, comprising the steps of:

(a) manufacturing a thermal transfer material which includes formation of a light to heat converting layer on a supporting body and formation of an image forming layer which contains at least one compound which is selected from compounds represented by following general formula (1) and following general formula (2);

(b) manufacturing an image receiving material which includes formation of an image receiving layer on a supporting body;

(C) superposing said thermal transfer material and said image receiving material such that the image forming layer and the image receiving layer contact one another;

(d) illuminating a laser imagewise; and (e) peeling said thermal transfer material and said image receiving material:

General Formula (1)

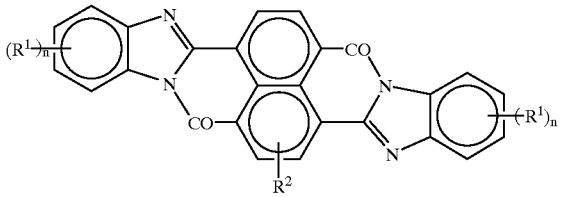

wherein, $R^1$ represents one of a hydrogen atom, an allyl group having 1 to 5 carbon atoms, a halogen atom, and an alkoxy group having 1 to 5 carbon atoms;

$R^2$ represents one of a hydrogen atom and an alkyl group having 1 to 5 carbon atoms; and n represents any integer of from 1 to 4;

General Formula (2)

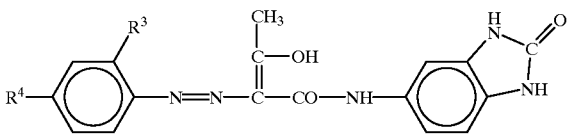

wherein, $R^3$ and $R^4$ respectively and independently represent one of a nitro group, a halogen atom, a methylsulfonyl group, and a cyano group.

18. A laser thermal transfer recording method according to claim 17, wherein after the step of peeling said thermal transfer material and said image receiving material, said method further comprises the step of superposing said image receiving material, on which an image has been formed, on another supporting body such that the image receiving surface contacts the supporting body, so as to transfer the image again.

* * * * *